US010092888B2

(12) United States Patent
Barksdale et al.

(10) Patent No.: US 10,092,888 B2
(45) Date of Patent: Oct. 9, 2018

(54) LINEAR RECIPROCATING ACTUATOR

(71) Applicant: GENESIS TECHNOLOGIES, LLC, New Milford, CT (US)

(72) Inventors: Scott Meredith Barksdale, New Milford, CT (US); Lawrence Anthony Sasso, Jr., Austin, TX (US)

(73) Assignee: Genesis Technologies, LLC, New Milford, CT (US)

( * ) Notice: Subject to any disclaimer, the term of this patent is extended or adjusted under 35 U.S.C. 154(b) by 0 days.

(21) Appl. No.: 15/524,682

(22) PCT Filed: Nov. 6, 2015

(86) PCT No.: PCT/US2015/059478
§ 371 (c)(1),
(2) Date: May 5, 2017

(87) PCT Pub. No.: WO2016/073858
PCT Pub. Date: May 12, 2016

(65) Prior Publication Data

US 2017/0333857 A1 Nov. 23, 2017

Related U.S. Application Data

(60) Provisional application No. 62/076,510, filed on Nov. 7, 2014.

(51) Int. Cl.
*B01F 11/00* (2006.01)
*B01F 13/08* (2006.01)
*B01F 15/00* (2006.01)

(52) U.S. Cl.
CPC ..... *B01F 11/0082* (2013.01); *B01F 13/0827* (2013.01); *B01F 13/0863* (2013.01); *B01F 15/00331* (2013.01)

(58) Field of Classification Search
CPC ..... B01F 11/0082
See application file for complete search history.

(56) References Cited

U.S. PATENT DOCUMENTS 2,498,393 A 2/1950 Clewell
3,206,172 A 9/1965 Gaska et al.
(Continued)

FOREIGN PATENT DOCUMENTS

CA 2306466 4/1999
DE 102006020461 10/2007
(Continued)

OTHER PUBLICATIONS

Graber & Pfenninger GmbH, "Vibrating Mixer Industrial Types, Mixing liquids by vibration" (4 pages).
(Continued)

*Primary Examiner* — Abbas Rashid
(74) *Attorney, Agent, or Firm* — Ware, Fressola, Maguire & Barber LLP

(57) ABSTRACT

A linear reciprocating actuator for mixing, agitating, separation, continuous sampling and/or harvesting or filtration, gas mixing, and various other applications. The actuator may have a housing closed on one end, and attached to a vessel in a hermetically-sealed manner such that it is part of the fluidic envelope of the vessel. An agitation device may be attached to a shaft which is partially surrounded by the housing, or the agitation device may surround the housing where the housing protrudes into the vessel. The actuator enables agitation of the contents of a hermetically-sealed vessel without mechanical coupling from outside the fluidic envelope of the process. The agitation device is solely acted upon by a magnetic field, is contained entirely within the fluidic envelope of the process, and is not attached to the
(Continued)

vessel in any way. The magnetic flux which drives the agitation device passes through the housing.

14 Claims, 7 Drawing Sheets

(56) References Cited

U.S. PATENT DOCUMENTS

| | | | | |
|---|---|---|---|---|
| 4,465,377 | A * | 8/1984 | de Bruyne | B01F 13/0818 366/273 |
| 5,533,803 | A * | 7/1996 | Meier | B01F 13/0827 366/247 |
| 6,322,698 | B1 | 11/2001 | Rios et al. | |
| 6,462,439 | B1 | 10/2002 | Denne | |
| 6,491,422 | B1 | 12/2002 | Rütten et al. | |
| 6,908,223 | B2 | 6/2005 | Bibbo et al. | |
| 7,093,721 | B2 | 8/2006 | Imanse et al. | |
| 7,185,648 | B1 * | 3/2007 | Rand | A61M 15/009 128/200.23 |
| 7,407,631 | B2 * | 8/2008 | Swon | B01F 11/0082 366/273 |
| 7,682,067 | B2 | 3/2010 | West et al. | |
| 7,832,922 | B2 * | 11/2010 | Schoeb | B01F 7/00716 366/273 |
| 8,469,924 | B2 * | 6/2013 | Nguyen | A61B 17/00008 604/82 |
| 8,794,821 | B2 * | 8/2014 | Watkins | B01F 7/00675 366/276 |
| 8,815,182 | B2 * | 8/2014 | Smit | B01L 3/508 366/273 |
| 9,095,828 | B2 * | 8/2015 | Mennenga | B01F 11/0082 |
| 2004/0047232 | A1 * | 3/2004 | Terentiev | B01F 7/00908 366/273 |
| 2005/0249033 | A1 | 11/2005 | Krause | |
| 2007/0253288 | A1 | 11/2007 | Mennenga et al. | |
| 2009/0035856 | A1 | 2/2009 | Galliher et al. | |
| 2009/0245015 | A1 * | 10/2009 | Ni | B01F 11/0071 366/116 |
| 2009/0275121 | A1 | 11/2009 | Greller et al. | |
| 2009/0314666 | A1 * | 12/2009 | Reif | B01F 15/0085 206/221 |
| 2012/0121719 | A1 | 5/2012 | Tresco et al. | |
| 2014/0087424 | A1 | 3/2014 | Crowley et al. | |

FOREIGN PATENT DOCUMENTS

| | | |
|---|---|---|
| GB | 2467925 | 8/2010 |
| JP | 01210022 | 8/1989 |
| WO | 0241484 | 5/2002 |
| WO | 2005095578 | 10/2005 |
| WO | 2007099354 | 9/2007 |
| WO | 2013086371 | 6/2013 |
| WO | 2014051503 | 4/2014 |

OTHER PUBLICATIONS

Woodside, S. M. et al., "Mammalian cell retention devices for stirred perfusion bioreactors," Cytotechnology 28, 1998, pp. 163-175.

Pall Life Sciences, "Integrity LevMixer Industrious Buffer and Media Machine," 2014 (2 pages).

Meissner Filtration Products, "Saltus Single-Use Mixing System," 2013 (2 pages).

"BioBLU(R) f Single-Use Vessels", Eppendorf, https://online-shop.eppendorf.com/OC-en/Bioprocess-44559/Vessels-66270/BioBLUf-Single-Use-Vessels-PF-157955.html (10 pages).

* cited by examiner

LINEAR RECIPROCATING ACTUATOR

CROSS-REFERENCE TO RELATED APPLICATION

The present application claims the benefit of U.S. Provisional Patent Application No. 62/076,510, filed on Nov. 7, 2015, which is hereby incorporated by reference in its entirety.

FIELD OF THE INVENTION

The present invention relates generally to a device that agitates liquids, colloids, gases, semi-solids, solids, or any other contents within a vessel. It is ideal for single-use (disposable) applications in the pharmaceutical and biotechnology industries but it is not limited to these industries or to single-use applications.

BACKGROUND OF THE INVENTION

Single-use sterile bag systems were introduced to the market in 1986. Initially, bags were used to replace glass carboys and as disposable shipping containers for media and buffers used for cell cultivation. The advantage of single-use vessels is elimination of cross-contamination, which is a major problem with stainless steel and glass containers that must be cleaned and sterilized between usages. The trends toward utilization of single-use agitation systems have increased over the past several years. Several agitation modalities have been developed for single-use applications including recirculation loops, rocking, and integral impeller techniques, but there are limitations with all of these methods. Vibrational agitation systems have been in existence for more than 40 years but sparingly utilized in pharmaceutical and biotechnology applications over concerns about cross contamination due to integrity in the shaft sealing designs. There have been recent attempts at deploying vibrating disk methods in disposable bags and some have proven successful but they require mechanical coupling of the shaft to the bag surface. This technique has limitations, in that it only enables the use of vibrating agitation in bags and is difficult to scale down. The vibrating disk technique has proven to be effective in a wide range of vessels and vessel volumes. Additionally, there has been an increase in the use of continuous bioprocessing including, sampling, harvesting, and perfusion which has been shown to result in membrane clogging when standard, lateral flow filtration techniques are employed without the inclusion of agitation or lateral flow. The sampling device facilitates the retention of cells while removing product, cellular debris, spent media, and other waste products. Other sampling devices either fail due to clogging, are too complex, cumbersome, or costly to operate and maintain.

The present invention addresses these various shortcomings in the art by providing a hermetically sealed housing which does not require mechanical coupling of the shaft or agitator to the actuator. The actuator can be applied to single-use (disposable) or re-useable equipment. It can be used with flexible containers (bags, etc.) or rigid vessels (plastic, glass, metal, etc.), and is scalable from microliter to kiloliter volumes. The apparatus can be used for mixing, agitating (i.e., foam breaking), separation, continuous sampling and/or harvesting (filtration), gas mixing, and various other applications. The agitation devices can be various mixing devices, screens, scaffolds, matrices, pistons, plungers, or any other device to meet specific agitation requirements. The actuator housing can be integral to the vessel or detachable.

BRIEF SUMMARY OF THE INVENTION

According to an embodiment of the invention, an actuating device is provided for mixing or agitation, which is comprised of at least a housing and an agitation device, and the agitation device is driven by magnetic flux through the walls of the housing, which has a "closed" end. The housing together with the vessel wall define a "fluidic envelope", where the material being processed is on the "inside" of the fluidic envelope, and the opposite side is referred to as the "outside". In some cases, there are ports which are part of the sampling device and are constructed in a manner for the purpose of transferring fluid into and/or out of the vessel. The actuating device can be inserted into the port, which is part of the vessel and allows for insertion of different devices, including sampling devices. These ports and any tubing attached to them are considered to be inside the fluidic envelope of the process. The closed end of the housing in the present invention can include such a fluidic port, where the port is an extension of the fluidic envelope.

The housing may be manufactured separately from the vessel. A permanent magnet or electromagnet coil can be integrated with the housing, or can be installed over or within the housing as a separate component. The housing may protrude into the vessel, in which case the closed end is located on the portion of the housing toward the inside of the vessel, or the housing can protrude out of the vessel or be enclosed within a vessel wall of sufficient thickness, in which case the closed end is located on the portion of the housing toward the outside of the vessel. The housing may be provided with threads for insertion into vessel ports, or may be bonded, glued, welded or press fit to the vessel, or mechanically attached to the vessel in any way. Alternatively, the vessel and housing can be manufactured as a single piece, where the housing is formed along with the vessel during an additive production process such as molding or casting, or is formed by removal of material from a piece of stock, or by any other production method capable of producing the vessel and housing with a single piece of material. The housing can be rigid, or it can be flexible, for example with external or internal rigid support. The housing may be part of a one-piece molded flexible bag type vessel.

An electromagnetic coil or permanent magnet can be mechanically coupled to either the inside or outside of the housing, and a permanent magnet or electromagnetic coil can be mechanically coupled to the agitator. In a preferred embodiment, there is at least one electromagnetic coil. In this case, when a current is applied to the electromagnetic coil, it generates a magnetic flux which is received by the permanent magnet or electromagnetic coil on the agitator, causing it to reciprocate. In this embodiment, an alternating current can be used to electrically drive the coil in alternating directions, or an on-off type current can be used in conjunction with gravity, or any spring return type mechanism including an encapsulated compressible fluid, or any other mechanical return mechanism, to provide reciprocating motion. In another embodiment, an alternating magnetic flux is produced by physically moving a permanent magnet on the side of the housing outside of the fluidic envelope. In further embodiments, more than one electromagnetic coil can be provided and the use between coils can alternate in order to reduce the likelihood of either coil heating excessively.

There are various arrangements of electromagnetic coils and magnets which achieve the same result, all of which are not necessarily described herein. The permanent magnet or magnets are always oriented such that the magnetic field is aligned with the axis of the housing.

In a preferred embodiment, a permanent magnet is located inside the fluidic envelope, while the electromagnetic coil is located outside. The housing protrudes toward the outside of the vessel, and the agitator is attached to a shaft or piston, which protrudes into the housing. The housing is surrounded by an electromagnetic coil. The shaft has one or more magnets fixed to it such that the magnets are within the magnetic flux of the electromagnetic coil. The coil is driven by an alternating current such that the magnets on the agitator shaft are forced to reciprocate within the housing, causing a controlled reciprocation of the agitator. Springs may be placed such that they restrict motion at the ends of the shaft's travel.

In another embodiment, the piston is housed entirely within the housing, and the housing is covered with a filtration membrane. Fluid is pumped through the housing, which requires flow through the membrane, enabling filtration, while the reciprocating motion of the piston causes an agitation at the membrane surface which clears the membrane of debris which would otherwise clog the membrane and reduce or block flow. The velocity of the piston's movement can be made faster in the direction which pushes fluid toward the inside of the vessel. This method creates a turbulent flow in the direction that clears the membrane, but a laminar flow in the direction that clog the membrane, thus allowing a significant improvement in the clearing of the membrane due to the significantly higher fluid shear under turbulent flow.

In another embodiment, the housing protrudes toward the inside of the vessel, and an electromagnetic coil is located within the housing, on the outside of the fluidic envelope. A permanent magnet is mechanically coupled to the agitator, which surrounds the housing. In a preferred embodiment, two magnets are attached to the agitator or agitator shaft, where the magnetic poles are oriented in opposite directions, and the magnets are separated by some distance similar to the length of the electromagnetic coil. This arrangement has been demonstrated to increase the force exerted on the agitator given the same electrical current. In another embodiment, the electromagnetic coil is located inside the fluidic envelope, while the permanent magnet is located outside. In this case one or more wires must pass from outside the fluidic envelope to inside. The wire or wires can be sealed to the vessel or housing to maintain a closed fluidic envelope. In another embodiment, two electromagnetic coils are used, where one is located within the vessel and the other outside. Various materials of construction can be used for all parts of the apparatus, generally selected for either single-use (disposable) or reusable purposes.

In another embodiment, more than one agitation or actuating device can be installed into the vessel.

The device can be constructed in various geometries and configurations. The housing, electromagnetic coils, permanent magnets, agitator, and agitator shaft, where applicable, can have round, square, or any other cross sectional shape.

In cases where a shaft protrudes into the housing, a seal can be added to isolate the housing cavity from the inside of the fluidic envelope.

According to a first aspect of the invention, an actuating device is provided comprising a housing, an electromagnetic coil configured to receive an electrical current, at least one magnetic element, and a piston attached to the at least one magnetic element. Application of a voltage to the electromagnetic coil creates a magnetic flux received by the at least one magnetic element, causing the at least one magnetic element and piston to move in a first linear direction from a first position to a second position. The at least one magnetic element and piston are configured to move from the second position to the first position in a second linear direction that is opposite the first linear direction.

According to an embodiment of the first aspect of the invention, the at least one magnetic element and piston are configured to move from the second position to the first position by reversing the polarity of voltage applied to the electromagnetic coil. The at least one magnetic element and piston are configured to move linearly between the first and second positions in a cyclical manner by applying the voltage across the electromagnetic coil and reversing the polarity of the voltage in a repeated manner.

In accordance with the first aspect of the invention, a sterile barrier is provided between the electromagnetic coil and the at least one magnetic element. In a first embodiment, the electromagnetic coil is positioned on an exterior of the housing and the at least one magnetic element is positioned on an interior of the housing. In a further embodiment, the electromagnetic coil is positioned on an interior of the housing and the at least one magnetic element is positioned on an exterior of the housing.

In an embodiment of the first aspect of the invention, the at least one magnetic element comprises two magnetic elements. The actuating device according to the first aspect of the invention may also comprise at least one spring configured to bias movement of each of the at least one magnetic elements and/or at least one stopper configured to bias against the at least one spring.

Further in accordance with an embodiment of the actuating device according to a first aspect of the invention, a first end of the piston of the actuating device is configured to be inserted into a vessel containing a fluid. The actuating device may comprise an external threaded section configured to be received by a corresponding threaded opening in said vessel.

In an embodiment of the actuating device of the first aspect of the invention, the actuating device comprises a plate attached to the first end of the piston. The plate can be an agitator plate comprising a plurality of conical holes through the agitator plate.

In a further embodiment of the actuating device of the first aspect of the invention, the piston is contained within a piston housing. The piston housing may comprise at least one fluid intake port and the actuating device may comprise at least one fluid outlet port. A porous membrane filter surrounds at least a portion of the piston housing including the at least one fluid intake port. The piston housing may include a plurality of lengthwise channels around the circumference of the piston housing. The actuating device is configured to intake a fluid and compounds in the fluid having a smaller size than the pores of the porous membrane filter for outlet through the at least one fluid outlet port. Movement of the piston from the first position to the second position causes the fluid to be ejected through the at least one fluid inlet port and clear the area surrounding the porous membrane.

In an additional embodiment of the actuating device according to the first aspect of the invention including a piston housing, the actuating device includes a gas inlet port, a porous mesh surrounding a portion of the piston housing and a plurality of disks comprising venturi ports around the piston within the piston housing.

In a further embodiment of the actuating device of the first aspect of the invention, the actuating device may comprise a cell or tissue retention device attached to a first end of the piston.

In embodiments of the actuating device according to the first aspect of the invention, at least one magnetic element and piston are configured to move from the second position to the first position by fluidic pressure against the piston. Additionally or alternatively, the at least one magnetic element and piston can be configured to move from the second position to the first position by a gravitational force.

According to a second aspect of the present invention, a system is provided. The system comprises a vessel configured to receive a fluid and an actuating device secured to the vessel. The actuating device comprises a housing, an electromagnetic coil configured to receive an electrical current, at least one magnetic element, and a piston attached to the at least one magnetic element. Application of a voltage to the electromagnetic coil creates a magnetic flux received by the at least one magnetic element, causing the at least one magnetic element and piston to move in a first linear direction from a first position to a second position. The at least one magnetic element and piston are configured to move from the second position to the first position in a second linear direction that is opposite the first linear direction. The at least one magnetic element and piston can be configured to move from the second position to the first position by reversing the polarity of voltage applied to the electromagnetic coil. The at least one magnetic element and piston can further be configured to move linearly between the first and second positions in a cyclical manner by applying the voltage across the electromagnetic coil and reversing the polarity of the voltage in a repeated manner.

According to a further embodiment of the system of the second aspect of the invention, the system may further comprise a controller device comprising a non-transitory computer readable medium and a processor, configured to control the voltage applied to the electromagnetic coil. The electromagnetic coil may be positioned on the exterior of the housing and the at least one magnetic element can be positioned on the interior of the housing.

According to an embodiment of the system of the second aspect of the invention, the actuating device comprises a threaded section configured to be inserted into a corresponding threaded opening in the vessel. The vessel may comprise a plurality of threaded openings configured to receive a plurality of actuating devices.

In a further embodiment of the system of the second aspect of the invention, the actuating device and the vessel are formed integrally.

According to a third aspect of the invention, an actuating device is provided comprising a housing, an external drive mechanism, at least one magnetic element, and a piston attached to the at least one magnetic element. The external drive mechanism causes the at least one magnetic element and piston to move in a first linear direction from a first position to a second position. The at least one magnetic element and piston are further configured to move from the second position to the first position in a second linear direction that is opposite the first linear direction.

According to a first embodiment of the actuating device of the third aspect of the invention, the external drive mechanism is an electromagnetic coil configured to receive an electrical current and application of a voltage to the electromagnetic coil creates a magnetic flux received by the at least one magnetic element and causes the at least one magnetic element and piston to move in the first linear direction from the first position to the second position.

According to a second embodiment of the actuating device of the third aspect of the invention, the external drive mechanism is a further magnetic element external to the housing and coupled to a pneumatic actuator. The further magnetic element causes the at least one magnetic element and piston to move in the first linear direction from the first position to the second position.

DETAILED DESCRIPTION OF THE DRAWINGS

The present invention will now be described with reference made to FIGS. 1-13.

Figure 1:
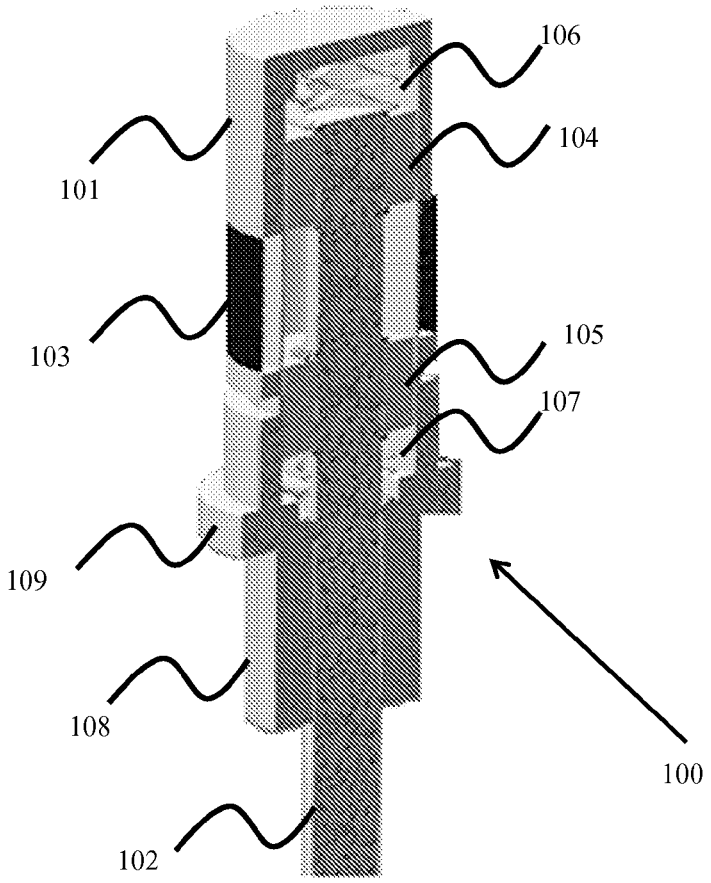
FIG. 1 shows a cross-sectional view of an actuating device according to an embodiment of the present invention.

An actuator device 100 in accordance with the present invention is shown in FIG. 1. The actuator device 100 includes a housing 101 and a shaft or piston 102, which extends partially into the housing 101. The piston 102 of the actuator device 100 is configured to provide a linear, reciprocating motion. In order to provide this linear, reciprocating motion, an electromagnetic coil 103 and one or more magnetic elements 104, 105 can be provided. In the embodiment shown in FIG. 1, the electromagnetic coil 103 is oriented around an outer surface of the housing 101 and the magnetic elements 104, 105 are placed inside the housing 101. The magnetic elements 104, 105 are attached to the piston 102. In alternative embodiments, the magnetic elements 104, 105 may be positioned outside the housing 101 and the electromagnetic coil 103 may be placed inside the housing 101. In further alternative embodiments, a single magnetic element 104 can be provided.

An electrical current supply (not shown) supplies electrical current to the electromagnetic coil 103. When the current is applied to the electromagnetic coil 103, a magnetic flux is generated which is received by the magnetic elements 104, 105. This causes magnetic elements 104, 105 and attached piston 102 to move linearly from a first position to a second position. The magnetic elements and attached piston 102 are configured to return that movement in the reverse direction, from the second position back to the first position, through one or more means. In one embodiment, the polarity of the voltage of the applied current can be reversed. An alternating current can be used to electrically drive the electromagnetic coil 103 in alternating directions, or an on-off type current can be used in conjunction with gravity, or any spring return type mechanism including an encapsulated compressible fluid, or any other mechanical return mechanism, to provide reciprocating motion of the magnetic elements 104, 105 and piston 102. In another embodiment, an alternating magnetic flux can be produced by physically moving a permanent magnet on the side of the housing 101 outside of the fluidic envelope. For example, a cylindrical magnet may be provided around the housing 101 and attached to a pneumatic cylinder or actuator.

The actuating device 100 therefore provides a piston 102 that is capable of linear reciprocating movement alternating between a first and second position. Because the electromagnetic coil 103 is separated from the magnetic elements 104, 105 by the housing 101, a sterile barrier is provided between electromagnetic coil 103 and the magnetic elements 104, 105 and piston 102. The magnet/piston assembly is actuated by the electromagnetic flux created between the electromagnet coil 103 and the magnetic elements 104, 105 and there is no direct connection from the magnetic elements 104, 105 or the piston 102 to the electromagnetic coil 103.

The actuating device 100 may also include one or more springs 106, 107 inside the housing 101, as shown in FIG. 1. The springs 106, 107 bias against the magnetic elements 104, 105 to restrict the movement of the magnetic elements 104, 105 and piston 102. A first spring 106 can be placed against the closed end of the housing 101 to bias the magnetic element 104 and piston 102 during an upstroke of the magnetic element 104 and piston 102. A stopper 108 can also be inserted into the housing 101, which biases against a second spring 107 during the down stroke of the magnetic element 105 and piston 102. In certain embodiments of the invention, it is envisioned that only one spring or no spring can be provided within the housing 101.

The actuating device 100 can further be provided with a mounting flange 109 affixed to the housing 101. The mounting flange 109 is configured to aid in mounting the actuating device 100 to a vessel, as described in further embodiments of the invention herein.

The components of actuating device 100, with the exception of the electromagnetic coil 103, magnetic elements 104, 105 and springs 106, 107, can be made from a variety of materials, including for example various polymer materials, which can vary depending on the operating temperature and sterilization temperature requirements for the actuating device 100. The size of the actuating device 100 can also vary depending on the application of the actuating device 100 that is required.

The actuating device according to the present invention can be used in apparatuses having a variety of applications, including for the agitation of liquids, colloids, gases, semi-solids or solids. Additional applications of the actuating device in bioprocesses can include mixing, continuous bioprocessing, perfusion or filtering, harvesting, sampling, gas mixing/dispersion, separation, foam breaking and tissue regeneration and cultures. The actuating device may also be used as a diaphragm pump device. It is further noted that the actuating device according to the invention is not limited to these applications, but it can be used for additional applications.

In accordance with one embodiment of the invention, the actuating device 100 can take the form of an apparatus for agitating or mixing a fluid sample, as shown for example in FIGS. 2-7. The actuating device 100 according to this embodiment includes an agitator plate 120 that is attached to the piston 102. The agitator plate 120 may include a plurality of conically shaped holes 121 that extend through the agitator plate 120. The agitator plate 120 can be attached to the piston 102 in a number of ways, including for example threading the piston 102 through an opening in the agitator plate 120, providing a screw or bolt through the agitator plate 120 into the piston 102, or forming the agitator plate 120 and piston 102 as an integral unit. The agitator plate 120 can be made in a variety of shapes and sizes depending on the application of the agitator plate 120 and the shape and size of the vessel 150 or 160.

The actuating device 100 can be used in connection with a pliable bag-like vessel 150 or a rigid vessel 160, which can include a fluid solution 152 or 162. For example, the actuating device 100 can be secured to the lid 161 of a rigid vessel 160. The lid 161 may comprise a threaded opening or port configured to receive a corresponding threaded section on the actuating device 100 for securely attaching the actuating device 100 to the vessel 160. However, the actuating device 100 can be secured to a vessel 150 or 160 in a variety of other means, including for example, integrally forming the actuating device 100 and lid 161. It is further envisioned that multiple actuating devices 100 can be utilized with a single vessel 150 or 160 for differing purposes by, for example, providing multiple threaded openings in a vessel lid 161.

Figure 2:
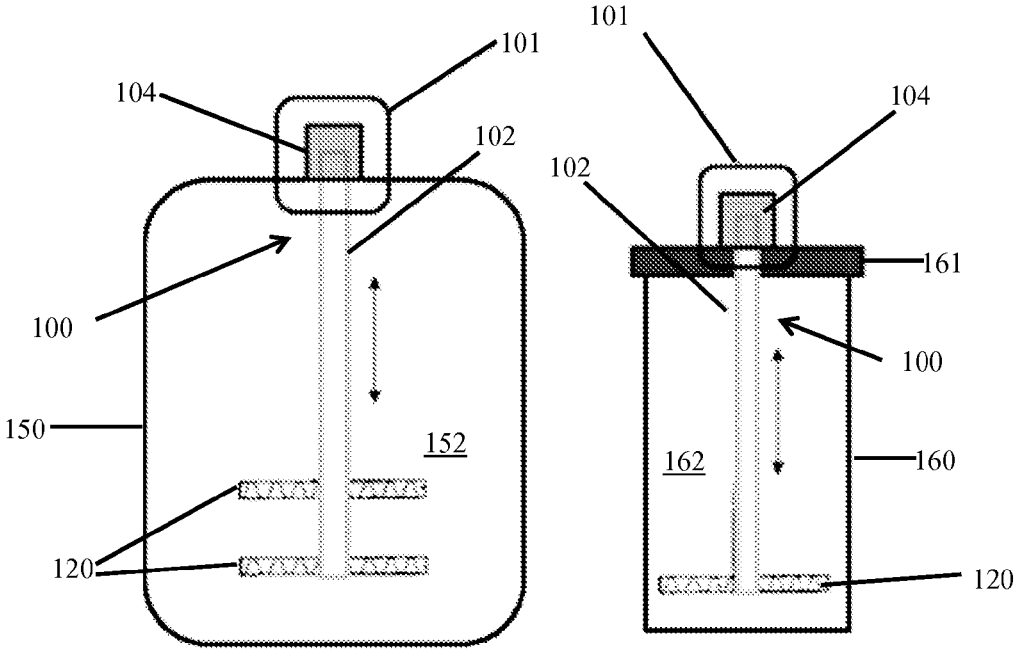
FIG. 2 shows a mixing application of the actuating device according to an embodiment of the present invention.

In the embodiments shown in FIG. 2 for example, the actuating device 100 with an agitator plate 120 is configured to mix a fluid solution 152 or 162. The piston 102, with attached agitator plate 120, moves linearly back and forth as described previously. Because the piston 102 is not attached to the container 150 or 160, the movement of the piston 102 and agitator plate 120 is independent of the container 150 or 160, eliminating flexure fatigue. The actuating device 100 can be configured to vary the frequency and stroke length of the piston 102 movement by a controller device.

In additional embodiments of the actuating device 100, one or more bellows may be provided, for example, around the piston 102 adjacent to the stopper 108. This embodiment may be preferred when the actuating device 100 is used in a solution where particulates are produced, wherein the bellows prevent the particulate from getting into the actuating device 100.

Figure 5:
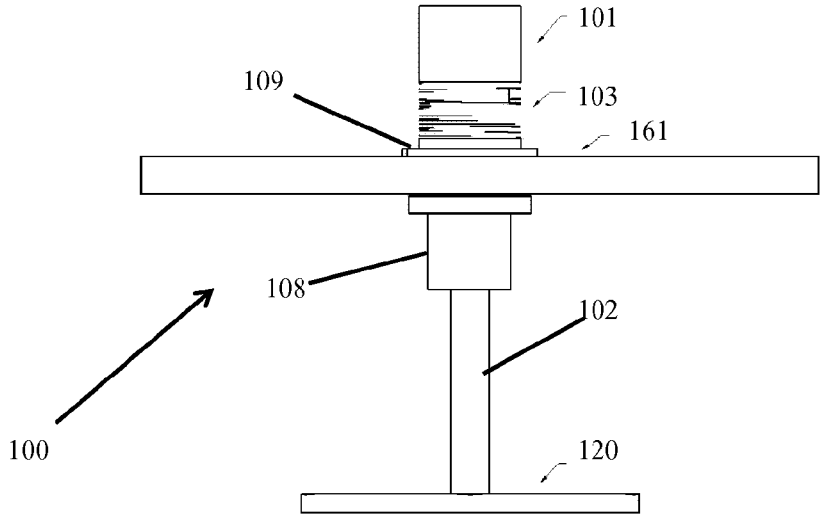
FIG. 5 shows a mixing apparatus according to an embodiment of the actuating device of the present invention.
Figure 6:
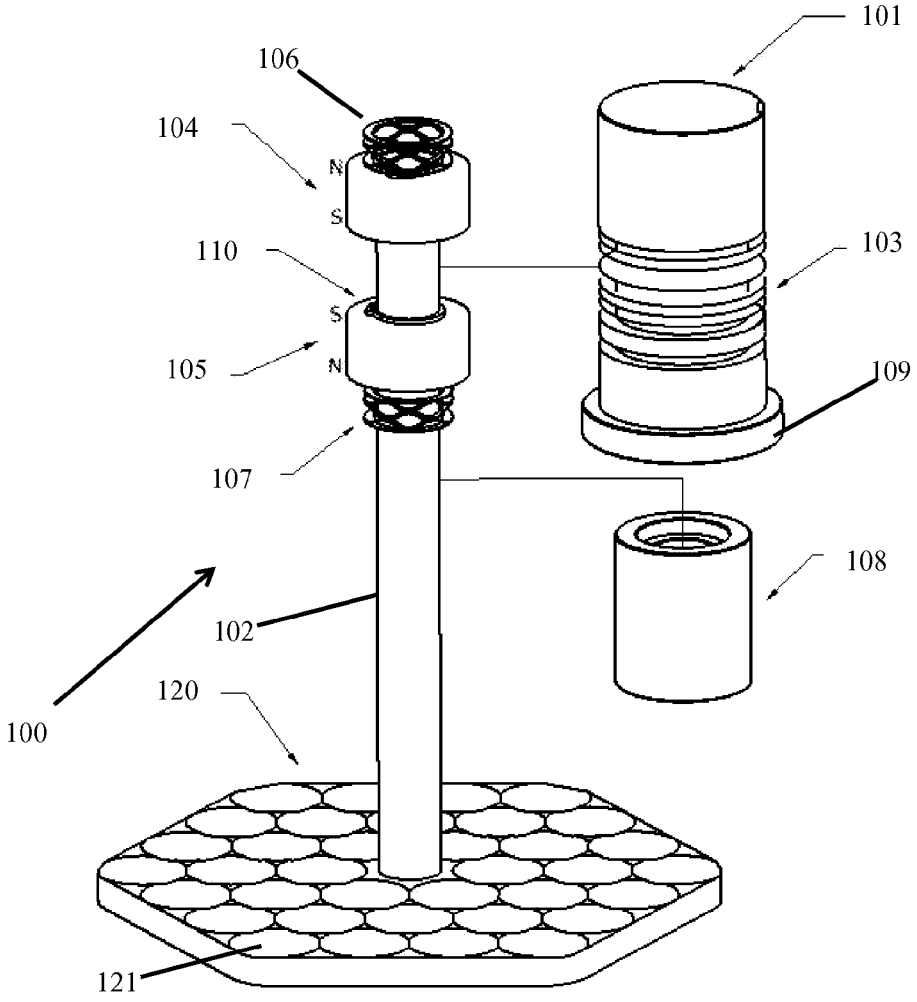
FIG. 6 shows a partially exploded view of the mixing apparatus according to an embodiment of the present invention.

An exemplary embodiment of the actuating device 100 configured for a mixing application is shown in FIGS. 5-6. In this embodiment, the housing 101 is provided with a closed end that would be positioned outside of a vessel 160. The electromagnetic coil 103 is placed on the interior or exterior of the housing 101 and the magnetic elements 104, 105 are placed on the piston 102, so as to be contained within the housing 101 when the actuating device 100 is fully assembled. One or more magnet retaining clips 110 can be provided to retain the magnetic elements 104, 105 in position on the piston 102 or the magnets 104, 105 may be permanently connected to the piston 102 via some bonding or encapsulation technique.

Figure 7:
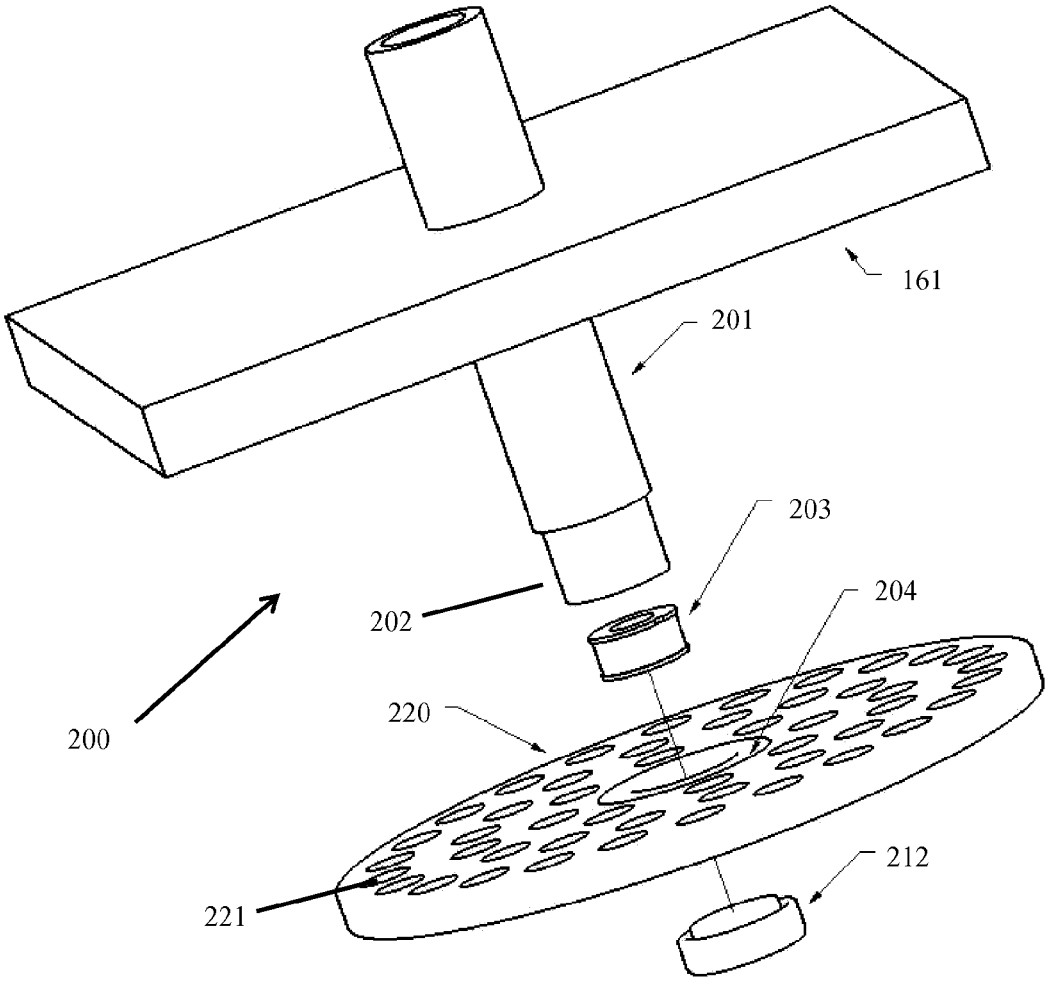
FIG. 7 shows a mixing apparatus according to a further embodiment of the present invention.

A second, alternative embodiment of an actuating device 200 configured for a mixing application is shown in FIG. 7. The actuating device 200 is provided with a closed end that is oriented towards the inside of a vessel 160. The housing 201 of the actuating device 200 is closed on its base end (relative to the orientation of the actuating device 200 as shown in FIG. 7) by a cap 212. An electromagnetic coil 203 is retained inside the housing 201. A magnetic element 204 is placed inside of a central opening through an agitator plate 220 comprising conical holes 221. When the housing 201 is inserted into the central opening in the agitator plate 220, the magnetic element 204, slides over the housing 201, which separates the magnetic element 204 from the electromagnetic coil 203. The magnetic element 204 is configured for linear reciprocating movement in combination with a piston 202 in the same manner as described herein in previous embodiments of the actuating device 100. It is noted that this arrangement of elements, including the electromagnetic coil 203 inside the housing 201 and the magnetic element 204 outside the housing 201, is not limited to the particular mixing application shown in FIG. 7, but this arrangement of elements of an actuating device in accordance with the present invention can be used in actuating devices for different applications, including those described herein.

Figure 3:
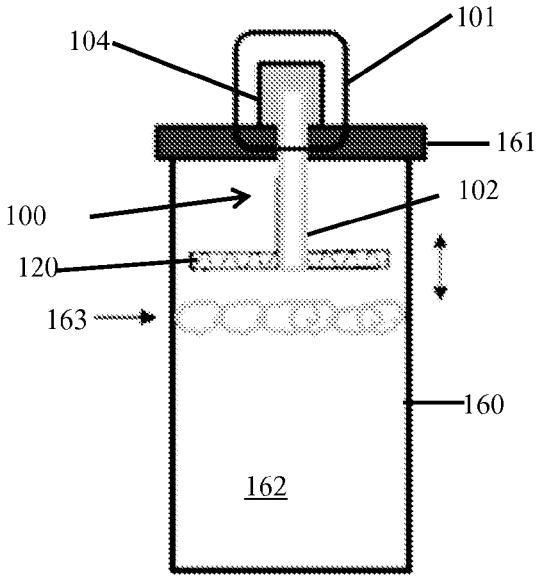
FIG. 3 shows a foam-breaking application of the actuating device according to an embodiment of the present invention.

In an additional application of the actuating device 100 shown in FIG. 3, the agitator plate 120 can be used for disrupting foam 163 that may accumulate in a vessel 160. Such an application eliminates the need for the addition of anti-foaming agents into the fluid solution 162.

In further embodiments, a similar embodiment of the actuating device can be used to aid in separation processes, such as expanded bed chromatography. A plate attached to a piston of the actuating device can be used to disrupt any clogging of the retention mechanisms in the chromatography device, to optimize the separation of the target product from the sorbent material.

Figure 4:
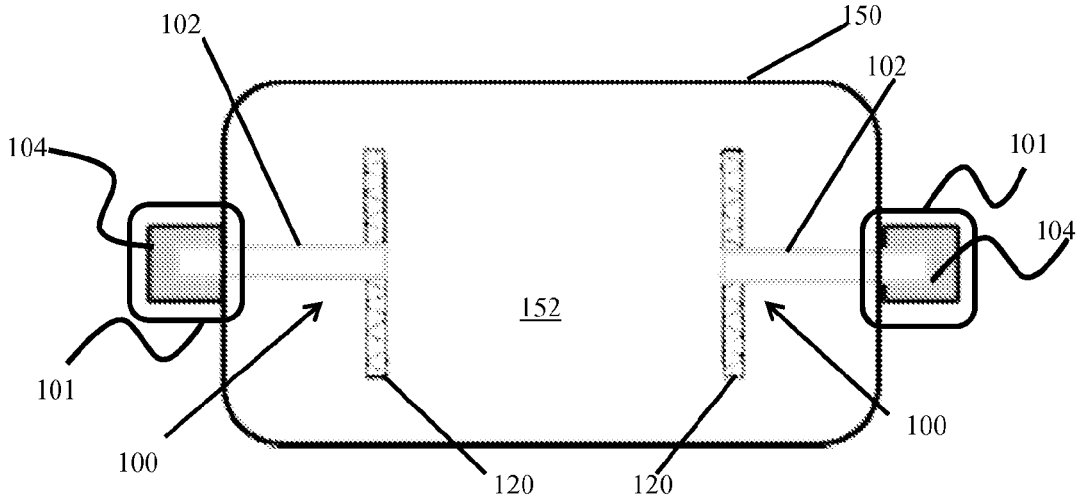
FIG. 4 shows an embodiment of the invention comprising multiple agitation devices in a single vessel.

It is further envisioned that multiple actuating devices 100 can be provided in connection with a single container 150, as shown for example in FIG. 4.

Additional applications of the agitation device according to the present invention are shown in FIGS. 8-13.

Figure 8:
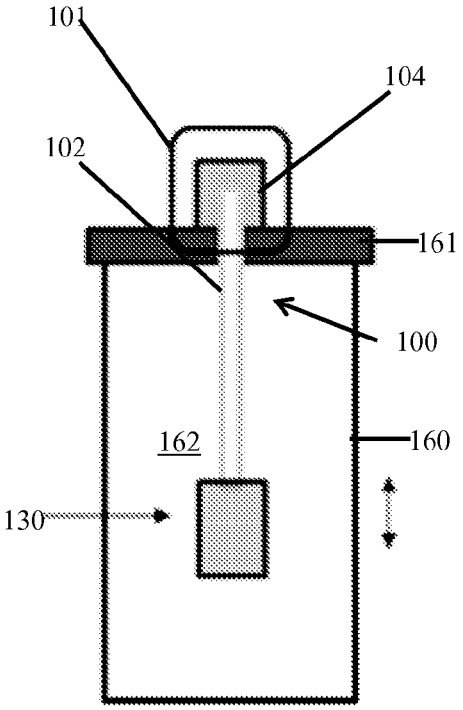
FIG. 8 shows a tissue or cell culture application of the actuating device according to an embodiment of the present invention.

An application of the actuating device 100 configured for use in a tissue or cell culture is shown in FIG. 8. A cell/tissue retention or scaffold 130 is attached to an end of the piston 102 for insertion into a vessel 160. The linear, reciprocating movement of the scaffold 130 attached to the piston 102 optimizes the exchange of gas and fluid with the contents (cells) within the scaffold 130 and enhances growth conditions. The movement of the scaffold 130 and piston 102 can be controlled by a controller device, as described herein.

Figure 9:
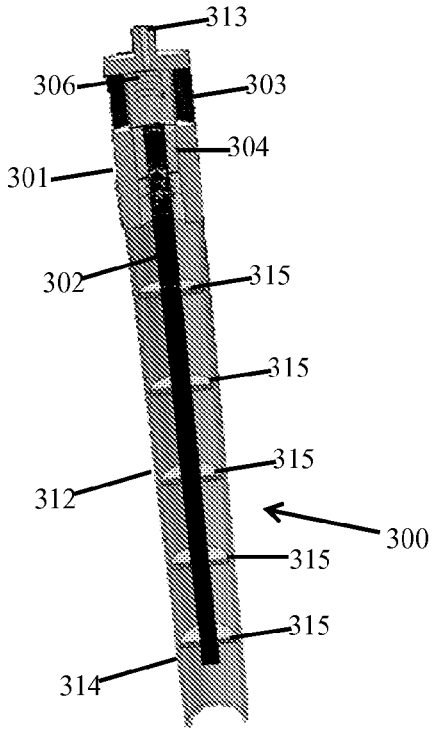
FIG. 9 shows a cross-sectional view of a gas mixing or dispersion system according to an embodiment of the present invention.
Figure 10:
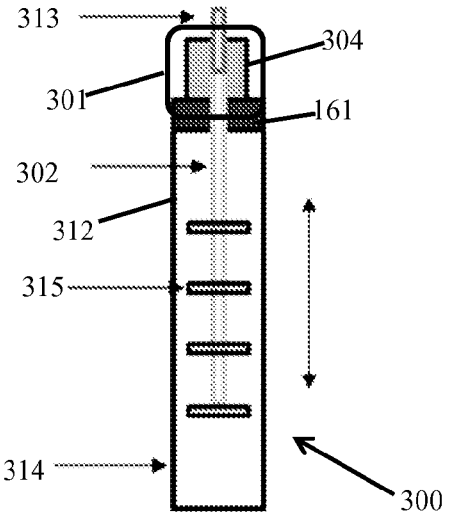
FIG. 10 shows a gas mixing or dispersion system comprising the actuating device according to an embodiment of the present invention.

A gas diffusion or dispersion actuating device 300 may further be provided in accordance with the present invention, as shown in FIGS. 9-10. The gas dispersion actuating device 300 includes a housing 301 and a piston 302, which extends partially into the housing 301. The piston 302 of the actuator device 300 is configured to provide a linear, reciprocating motion. In order to provide this linear, reciprocating motion, an electromagnetic coil 303 and a magnetic element 304 are provided. In the embodiment shown in FIG. 9, the electromagnetic coil 303 is oriented around an outer surface of the housing 301 and the magnetic element 304 is placed inside the housing 301. The magnetic element 304 is attached to the piston 302. In alternative embodiments, the magnetic element 304 may be positioned outside the housing 301 and the electromagnetic coil 303 may be placed inside the housing 301. In further alternative embodiments, more than one magnetic element can be provided.

When the current is applied to the electromagnetic coil 303, a magnetic flux is generated which is received by the magnetic element 304 and causes magnetic element 304, and attached piston 302 to move linearly from a first position to a second position. The magnetic element 304 and attached piston 302 are configured to return that movement in the reverse direction, from the second position back to the first position, through one or more means, previously described herein. A spring 306 or more than one spring 306 can be provided to restrict and bias movement of the piston 302.

The gas diffusion actuating device 300 further comprises a piston housing 312 surrounding the portion of the piston 302 that is not surrounded by the housing 301. At one end of the actuating device 300, a gas inlet port 313 is provided. At the opposing end of the actuating device 300, the piston housing 312 takes the form of a porous membrane or mesh 314. Inside the piston housing 312, a plurality of venturi disks 315 are provided attached to and around the piston 302.

A gas or gases are supplied into the actuating device 300 through the gas inlet port 313. The linear movement of the piston 302 causes the gas or gases to be dispersed and mixed into a fluid or solution, in which the actuating device 300 is inserted. The gas is dispersed through the porous mesh 314. The pores in the porous mesh 314 can be in varying sizes in order to provide a range of bubble sizes of the dispersed gas. The disks 315 and attached piston 312 can be configured to reciprocate at variable frequencies and stroke lengths by a controller device in order to provide a range of gas mixing and dispersion capabilities.

Figure 11:
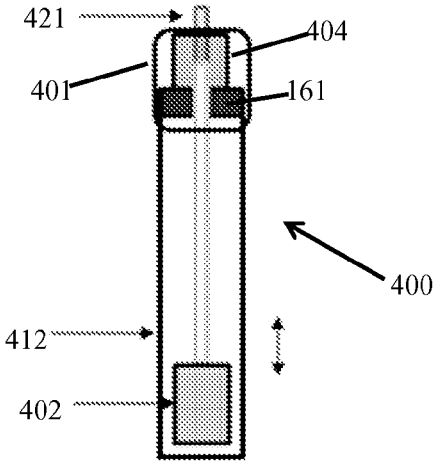
FIG. 11 shows a perfusion application of the comprising the actuating device according to an embodiment of the present invention.
Figure 12:
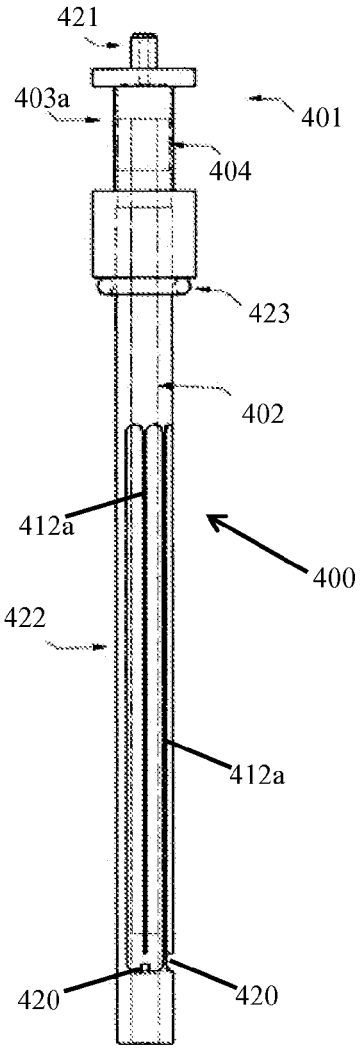
FIG. 12 shows a perfusion (filtration) apparatus according to an embodiment of the present invention.
Figure 13:
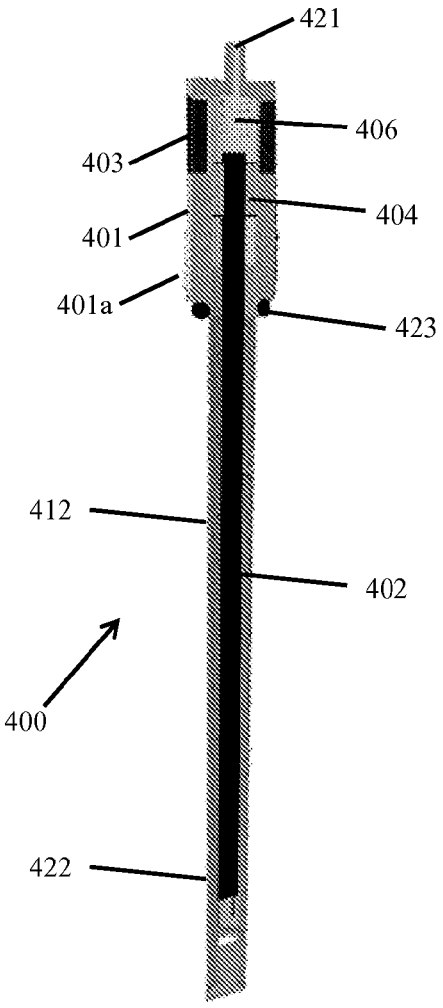
FIG. 13 shows a cross-sectional view of a perfusion apparatus according to an embodiment of the present invention.

A further application of the present invention is shown in FIGS. 11-13, which show a perfusion actuating device 400. The perfusion actuating device 400 provides for sterile removal of a sample product from a vessel, such as removing a compound generated by cells in cell culture vessel.

The perfusion actuating device 400 includes a housing 401 and a piston 402, which extends partially into the housing 401. The piston 402 of the actuator device 400 is configured to provide a linear, reciprocating motion. In order to provide this linear, reciprocating motion, an electromagnetic coil 403 and a magnetic element 404 are provided. In the embodiment shown in FIGS. 11-13, the electromagnetic coil 403 is oriented around an outer surface of the housing 401 within a coil receiving zone 403*a* formed in the housing 401, and the magnetic element 404 is placed inside the housing 401. The magnetic element 404 is attached to the piston 402. In alternative embodiments, the magnetic element 404 may be positioned outside the housing 401 and the electromagnetic coil 403 may be placed within the interior of the housing 401, such that the housing 401 serves as a protective cover so the coil 403 may remain free of environmental conditions including dust, debris, and moisture. In further alternative embodiments, more than one magnetic element 404 can be provided. The housing 401 may be provided with a threaded section 401*a* for inserting the perfusion actuating device 400 into a vessel having a corresponding threaded opening. An O-ring 423 may further be provided with the actuating device 400, which provides a fluidic seal between the housing 401 and the vessel or container.

When the current is applied to the electromagnetic coil 403, a magnetic flux is generated which is received by the magnetic element 404 and causes magnetic element 404, and attached piston 402 to move linearly from a first position to a second position. The magnetic element 404 and attached piston 402 are configured to return that movement in the reverse direction, from the second position hack to the first position, through one or more means, previously described herein. A spring 406 or more than one spring 406 can be provided to restrict and bias movement of the piston 402.

The perfusion actuating device 400 further comprises a piston housing 412 surrounding the portion of the piston 402 that is not surrounded by the housing 401. The piston housing 412 may include a plurality of channels 412*a*, which are oriented lengthwise (i.e., parallel with the piston) along the piston housing 412 and are positioned around the circumference of the piston housing 412. A porous membrane filter 422 is placed over the piston housing 412. The porous membrane filter 422 can be a membrane-like material having microscopic pores that adheres to the surface of the piston housing 412, or in alternative embodiments, may be a porous cartridge around the piston housing 412.

At one end of the actuating device 400, which would be the end inserted into a solution in a vessel or container, one or more fluid exchange or inlet ports 420 is provided on the piston housing 412. Fluid in the solution is continuously diffusing through the porous membrane filter 422, under controlled flow conditions, into the piston housing 412 of the actuating device 400 through the fluid exchange ports 420 and upon linear movement of the piston 402 in a downward motion (relative to the orientation of the actuating device 401 shown in FIGS. 12-13), the fluid is forced out through the fluid exchange ports 420 and into the channels 412*a*, creating hydraulic pressure which displaces any objects or material that are within the pores of the porous membrane filter 422 obstructing fluid movement through the mesh/membrane/filter material of the porous membrane filter 422. At the opposing end of the actuating device 400, a fluid outlet port 421 is provided, which is in fluid communication with the fluid exchange ports 420. The fluid outlet port 421 can be connected to tubing to deliver an extracted fluid sample to a separate vessel In operation of the perfusion actuating device 400, when the piston 402 is caused to move linearly away from the fluid solution in a vessel (i.e., when the piston 402 moves upward as the perfusion actuating device 400 is shown oriented in FIGS. 12 and 13), the pressure differential between the interior of the piston housing 412 and the fluid solution can cause the fluid from the vessel to flow into the piston housing 412 through the fluid exchange ports 420. Particulates that are smaller in size than the pores of the porous membrane filter 422 also are pulled through the porous membrane filter 422 into the fluid exchange ports 420. The porous membrane filter 422 can be provided with pores having a particular diameter in order to allow for the recovery of particulates having a certain size while enabling the retention of others exceeding the diameter of the pores. For example, in an embodiment of the present invention, the perfusion actuating device 400 can be used in a cell culture process, in which the cells are generating an antibody or other cell-derived products to be recovered. The pore size on the porous membrane filter 422 can be selected to allow the antibody or other cell-derived product to pass through the porous membrane filter 422 while preventing the cells from passing through. The fluid and associate particulate that enter the piston housing 412 of the perfusion actuating device can be extracted from the vessel through the fluid outlet port 421, which can be connected to a separate extraction vessel by way of tubing and other means known in the art. An external pump may also be provided for drawing fluid through the actuating device 400.

When the piston 402 is caused to move linearly towards the fluid solution in a vessel (i.e., when the piston 402 moves downward as the perfusion actuating device 400 is shown oriented in FIGS. 12 and 13), fluid present in the piston housing 412 is ejected through the fluid exchange ports 420. As the fluid exits the piston housing 412 through the fluid exchange ports 420, the pressure pulse created by this movement of the piston 402 causes fluid to travel in the channels 412*a* on the exterior of the piston housing 412 and the fluid passes through the porous membrane filter 422 along the channels 412*a* back into the fluid solution in the vessel. This causes any particulate matter that is attached to the porous membrane filter 422 or trapped in the pores to be dispersed in the fluid solution. As a result, the porous membrane filter 422 is cleared of particulate matter that would block the movement of fluid and small compounds through the porous membrane filter 422 when the linear movement of the piston 402 is reversed for the intake of fluid, as previously described.

Electrical control of the actuating devices described herein may require a powered down stroke and a powered upstroke of the piston. The filtration design could potentially be powered only in one direction, allowing the piston to return using only the fluid shear of the liquid pumped through, or it can be powered in both directions. The duration and power for the down stroke and upstroke can be different depending on the application. Powering the unit can be performed by applying a voltage across an electromagnet coil, and periodically reversing the polarity of the voltage.

A variety of types of electronics can be used to produce this required output. For example, a common circuit known in the field as an H-bridge can be used to arrange relays, solid state relays, transistors, or other switching devices to alternately power the coil to a battery or DC power supply. A microcontroller or other computing device can be included to allow programming of the duration and power of the down stroke and upstroke respectively. Alternatively, an alternating current power supply can be used to generate a control signal with reversing polarity.

A controller device connected to the electrical current supply for an actuating device described herein may comprise a non-transitory computer readable storage medium, such as a memory that may be stored with computer programming instructions for implementing one or more routines or operations of the actuating device, including various stroke magnitudes and frequencies and various output voltages, and a processor for executing the instructions causing the actuating device to operate as described herein. A user interface may further be provided in combination with the controller device to allow user interaction and control of the actuating device. In certain embodiments of the invention, the electrical current supply can be a 110-240 V alternating current power supply.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed:

1. An actuating device comprising:

a housing;

an electromagnetic coil positioned on an exterior of the housing and configured to receive an electrical current;

at least one magnetic element positioned on an exterior of the housing;

a piston attached to the at least one magnetic element;

at least one fluid outlet port; and a porous membrane filter;

wherein the piston is contained within a piston housing comprising at least one fluid inlet port and the porous membrane filter surrounds at least a portion of the piston housing including the at least one fluid inlet port;

wherein a sterile barrier is provided between the electromagnetic coil and the at least one magnetic element; and wherein application of a voltage to the electromagnetic coil creates a magnetic flux received by the at least one magnetic element and causes the at least one magnetic element and piston to move in a first linear direction from a first position to a second position.

2. The actuating device according to claim 1, wherein the at least one magnetic element and piston are configured to move from the second position to the first position by reversing the polarity of voltage applied to the electromagnetic coil.

3. The actuating device according to claim 1, wherein the at least one magnetic element comprises two magnetic elements.

4. The actuating device according to claim 1, further comprising at least one spring configured to bias movement of each of the at least one magnetic elements.

5. The actuating device according to claim 4, further comprising at least one stopper configured to bias against the at least one spring.

6. The actuating device according to claim 1, wherein a first end of the piston of the actuating device is configured to be inserted into a vessel containing a fluid.

7. The actuating device according to claim 6, further comprising an external threaded section configured to be received by a corresponding threaded opening in said vessel.

8. The actuating device according to claim 1, wherein the piston housing comprises a plurality of lengthwise channels forming a reduced diameter filter section around the circumference of the piston housing.

9. The actuating device according to claim 1, wherein the actuating device intakes a fluid and compounds in the fluid having a smaller size than pores of the porous membrane filter for outlet through the at least one fluid outlet port, and wherein movement of the piston from the first position to the second position causes the fluid to be ejected through the at least one fluid inlet port and wherein a down stroke of the piston generates a unidirectional hydraulic pressure pulse which produces transverse outflow through the filter membrane displacing fluid, gas, and any objects within or on the pores of the membrane rendering the pores clear for fluid inflow.

10. The actuating device according to claim 1, wherein the at least one magnetic element and piston are configured to move from the second position to the first position by fluidic pressure against the piston.

11. The actuating device according to claim 1, wherein the at least one magnetic element and piston are configured to move from the second position to the first position by a gravitational force.

12. An actuating device comprising:

a housing;

an external drive mechanism positioned on an exterior of the housing and;

at least one magnetic element positioned on an interior of the housing;

a piston attached to the at least one magnetic element;

at least one fluid outlet port; and a porous membrane filter;

wherein the piston is contained within a piston housing comprising at least one fluid inlet port and the porous membrane filter surrounds at least a portion of the piston housing including the at least one fluid inlet port;

wherein a sterile barrier is provided between the external drive mechanism and the at least one magnetic element; and wherein the external drive mechanism causes the at least one magnetic element and piston to move in a first linear direction from a first position to a second position.

13. The apparatus according to claim 12, wherein the external drive mechanism is an electromagnetic coil configured to receive an electrical current, and wherein application of a voltage to the electromagnetic coil creates a magnetic flux received by the at least one magnetic element and causes the at least one magnetic element and piston to move in the first linear direction from the first position to the second position.

14. The apparatus according to claim 12, wherein the external drive mechanism is a further magnetic element external to the housing and coupled to a pneumatic actuator, wherein the further magnetic element causes the at least one magnetic element and piston to move in the first linear direction from the first position to the second position.

* * * * *